United States Patent [19]

Shigehara

[11] 4,027,279

[45] May 31, 1977

[54] DEVICE FOR ATTACHING LEADS TO A TRANSFORMER OR THE LIKE

[76] Inventor: Katsumi Shigehara, 1729, Kashiwagaya Ebina, Kanagawa, Japan

[22] Filed: July 15, 1976

[21] Appl. No.: 705,675

[30] Foreign Application Priority Data

July 21, 1975 Japan ..... 50-88400

[52] U.S. Cl. ..... 336/90; 174/138 F; 336/192; 336/198; 339/103 R; 339/198 J

[51] Int. Cl.[2] ..... H01F 15/10

[58] Field of Search ..... 336/192, 198, 208, 90; 339/103 R, 103 M, 210 R, 36, 116 R, 198 J; 310/71; 174/138 F

[56] References Cited

UNITED STATES PATENTS

| | | | |
|---|---|---|---|
| 2,710,949 | 6/1955 | Happe et al. | 339/210 R X |
| 2,925,578 | 2/1960 | Huff et al. | 339/210 R X |
| 2,953,758 | 9/1960 | Stanwyck | 336/192 X |
| 3,025,490 | 3/1962 | Hicks | 339/210 R |
| 3,165,574 | 1/1965 | Carling | 174/138 F X |
| 3,273,105 | 9/1966 | Klassen | 339/210 R X |
| 3,742,412 | 6/1973 | Lakin | 336/192 |
| 3,781,741 | 12/1973 | Weiner | 336/198 X |
| 3,909,761 | 9/1975 | Miles | 336/192 |

*Primary Examiner*—Thomas J. Kozma
*Attorney, Agent, or Firm*—Marshall & Yeasting

[57] ABSTRACT

Leads electrically connected to the respective terminal portions of coiled wires in a core-type transformer are each provided with a flange on the insulating covering. A set of lugs formed on each of two opposite ends of a coil cover or of a coil bobbin have first grooves in spaced side-by-side relationship for receiving parts of the leads and second grooves arranged crosswise with the respective first grooves for receiving their flanges. A pair of lead covers are snapped into position to enclose the parts of the leads together with the flanges thereon and their connections to the terminal portions of the coiled wires, in such a manner that the leads can be positively retained in position in the respective grooves.

6 Claims, 5 Drawing Figures

DEVICE FOR ATTACHING LEADS TO A TRANSFORMER OR THE LIKE

BACKGROUND OF THE INVENTION

This invention relates to means for attaching leads to an electrical device such as a transformer, solenoid, relay and so forth. The means of this invention have particular utility in conjunction with small-sized transformers such as those used for communications purposes, but with no unnecessary limitations thereto being intended.

According to the usual practice heretofore followed in attaching leads to a core-type transformer of the class under consideration, adhesive tape of electrically insulating material has been employed for directly mounting the leads in spaced-apart positions on the coils of wire which have been wound on a hollow, flanged bobbin. The terminal portions of the coiled wires are first tentatively wound around the bared extremities of the respective leads, and the tentative connections are then dip soldered, that is, dipped in a bath of molten solder. Finally, adhesive tape may be applied again for protection and insulation of the soldered connections.

This conventional practice is objectionable in that, being supported merely by adhesive tape, the leads are easy to suffer displacement during the subsequent handling of the transformer, thus giving rise to the possibility of short-circuiting and of damaging the connections between leads and coils. Another objection is that the practice requires so much manual labor as to result in a substantial increase in the manufacturing cost of the transformers. As an additional disadvantage, the completed transformers are not at all satisfactory in external appearance.

SUMMARY OF THE INVENTION

It is an object of this invention to provide means useful in attaching leads to an electrical device such as, particularly, a transformer or the like which requires a number of such leads.

Another object of the invention is to provide means of the character described whereby leads attached to a desired electrical device can be positively retained in position practically against any possibility of short-circuiting or of ruining their connections to the conductors of the device.

A further object of the invention is to materially reduce the amount of manual labor heretofore required for attaching leads to transformers and the like and hence to decrease their manufacturing costs.

A still further object of the invention is to provide a transformer or like electrical device to which leads are attached by such means that the completed device is highly satisfactory from an aesthetic point of view.

For attaining these and other objects, this invention contemplates the use of a lead having a flange formed on its insulating covering. An electrical device to which the leads are attached has formed therein spaced-apart first grooves for receiving the respective leads, and second grooves arranged crosswise with the respective first grooves for receiving the flanges. After being electrically connected to the desired conductors of the device, the leads are partly covered by means such that they are positively retained in the respective grooves.

In a preferred embodiment of this invention, in which the invention is adapted for a transformer, a pair of snap-on covers are employed for covering parts of the leads and their connections to the terminal portions of the coiled wires. The use of such snap-on covers is preferable as they facilitate the attachment of the leads and render the completed transformer attractive in external appearance.

The above and various other objects, features and advantages of this invention and the manner of attaining them will become more apparent, and the invention itself will best be understood, upon consideration of the following description taken in connection with the accompanying drawings showing some preferred embodiments of the invention.

DESCRIPTION OF THE PREFERRED EMBODIMENTS

Figure 1:
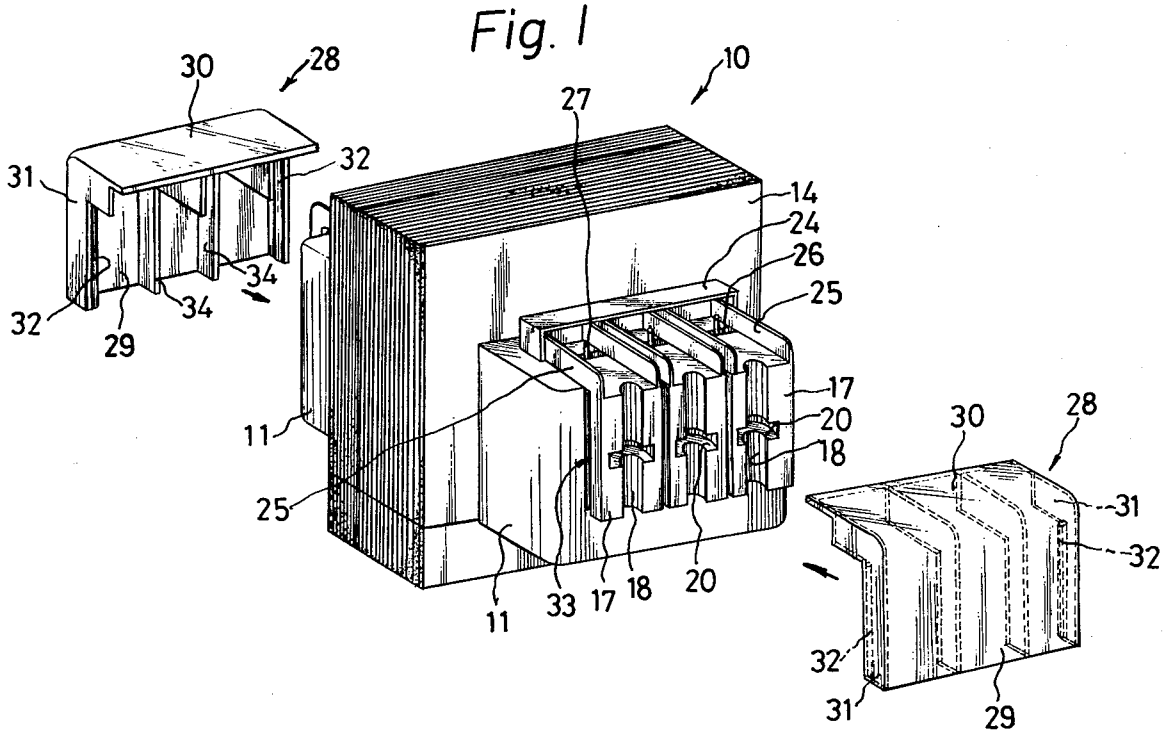
FIG. 1 is a perspective view of a core-type transformer incorporating the means of this invention, the transformer being shown in a condition before attachment of leads thereto and with a pair of lead covers removed.
Figure 2:
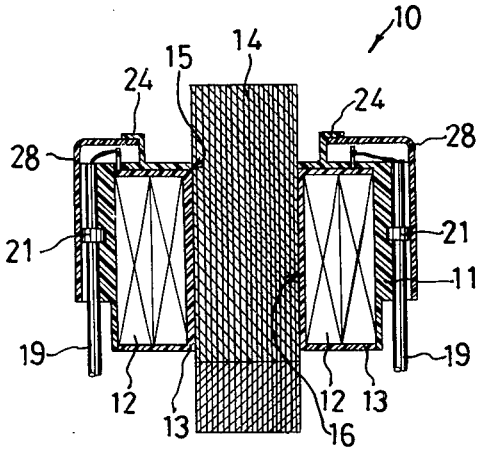
FIG. 2 is a vertical sectional view of the completed transformer, the view showing the leads attached and the lead covers mounted in position.

In the first preferred embodiment of this invention shown in FIGS. 1 and 2, the invention is applied to a core-type transformer 10 which comprises a coil cover 11 of electrically insulating material enclosing and protectively covering multiturn coils of wire 12 wound on a hollow, flanged bobbin 13, and a core 14 made of thin sections or laminations of steel or the like stacked side by side.

Substantially boxlike in shape, the coil cover 11 has an opening 15 formed centrally in its top so as to be in register with the hollow 16 of the bobbin 13. As is well known, the core 14 consists of E- and I-shaped sections, and the center leg or limb of the E-shaped section is inserted into the opening 15 of the coil cover 11 and the hollow 16 of the bobbin 13. The two sections of the core 14 are then rigidly interconnected so as to form the usual double closed magnetic circuit. It is understood that, in the completed transformer, the core 14 is to be at least partly enclosed in a suitable covering, not shown, that may be equipped with mounting means.

In accordance with this invention, a plurality of lugs 17 are formed in spaced side-by-side relationship on each of two opposite end faces of the coil cover 11 which are disposed on both sides of the core 14. Each of these lugs 17 has formed therein a vertically extending, relatively long first groove 18, preferably of semicircular cross section, for receiving part of a lead 19 (shown on an enlarged scale in FIG. 3), and a relatively short second groove or recess 20 for receiving a flange 21 on the insulating covering 22 of the lead 19. The first and second grooves 18 and 20 in each lug 17 cross each other.

Figure 3:
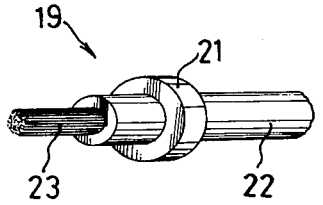
FIG. 3 is an enlarged, fragmentary perspective view of one of the leads attached to the transformer of FIGS. 1 and 2.

With particular reference to FIG. 3, each of the leads 19 to be attached to the transformer 10 in accordance with the invention comprises a conductor 23 shown as a combination of wires, the insulating covering 22 of polyvinyl chloride or other material surrounding the conductor, and the flange 21 in the shape of a ring formed on the insulating covering adjacent one extremity of the lead. The flange 21 may be either formed integral with the insulating covering 22 or, produced separately, fixedly mounted on the covering with or without use of an adhesive. A suitable length of the conductor 23 must be bared at the flange carrying extremity of each lead for electrical connection to the respective terminal portion of the coiled wires 12 of the transformer 10, as will be later described in greater detail.

As will be clearly seen from FIG. 2, parts of the leads 19 of the foregoing construction are relatively neatly received in the respective first grooves 18 in the lugs 17, with their flanges 21 engaged in the respective second grooves 20 and with the bared extremities of their conductors 23 directed upwardly.

With reference to both FIGS. 1 and 2, a pair of hoods 24 are formed on the top of the coil cover 11 on the opposite sides of the core 14. Each of these hoods has an open side which is directed away from the core. A plurality of pairs of parallel spaced partitions 25 are formed on the coil cover 11 so as to extend from within each hood 24 to the top ends of the respective lugs 17, and the top cover has further formed therein a row of openings 26 which are located between the respective paired partitions 25.

Projecting upwardly through the respective openings 26 are pins 27 which are erected on the top flange of the bobbin 13 and around which the respective terminal portions of the coiled wires 12 are at least partly wound lightly. Although of optional nature, the pins 27 will make it easier to draw the terminal portions of the coiled wires out of the coil cover 12 when the cover is placed over the coiled bobbin 13 during assemblage.

For the desired electrical connection between coils and leads, the terminal portions of the former may first be manually connected to the bared conductors 23 of the latter on a tentative basis. These tentative connections may then be made fast by the so-called dip soldering process, as has been practiced heretofore. Usually, the core 14 is mounted on the coil cover 11 in the above described manner after the dip soldering of the tentative connections between coils and leads.

As may be apparent, the aforesaid partitions 25 on the coil cover 11 are intended to position or isolate from each other the connections between coils and leads and hence to obviate the possibility of short-circuiting. The provision of the partitions 25, however, is not of absolute necessity, for reasons referred to hereinbelow. Preferably, the coil cover 11 together with the grooved lugs 17 and hoods 24, with or without the partitions 25, should be integrally formed of plastics material, as by injection molding.

Shown at 28 are a pair of lead covers of the snap-on type for enclosing parts of the leads 19 and the exposed terminal portions of the coils of wire 12 connected thereto. Substantially in the shape of an inverted L, each lead cover 28 comprises a relatively broad vertical portion 29, a horizontal top portion 30 and a pair of side portions 31, which can all be integrally molded of electrically insulating and suitably resilient material.

For permitting the lead covers 28 to snap into position on the opposite ends of the coil cover 11, a pair of ribs 32 are formed on and along the vertical edges of the side portions 31 of each lead cover so as to be directed toward each other. The pair of ribs 32 are intended to be received in a pair of grooves 33 (one seen in FIG. 1) formed on both sides of the set of lugs 17 on each end face of the coil cover 11.

Thus, as the pair of lead covers 28 are forced against the lugs 17 on the opposite end faces of the coil cover 12, each pair of ribs 32 will temporarily be spread away from each other by the lugs and will then become engaged in the respective grooves 33 by virtue of the resiliency of the lead covers. Since the top portion 30 of each lead cover is partly caught under the respective hood 24, as shown in FIG. 2, the lead cover can be locked in position practically against any possibility of accidental detachment.

It will be observed from a consideration of FIG. 2 that the lead covers 28 when mounted in position on the coil cover have their inside surfaces pressed against the leads 19, or against their flanges 21, thereby positively holding the leads in the respective first grooves 18 against the possibility of lateral displacement. Furthermore, since the flanges 21 of the leads are engaged in the second grooves 20 arranged crosswise with the respective first grooves, the leads can also be prevented from longitudinal displacement in spite of a pull which may be exerted on the leads during the subsequent handling of the transformer.

Preferably, partitions 34 each in the shape of an inverted L may be formed on the inside surface of each lead cover 28 for isolating from each other the leads 19 and the terminal portions of the coiled wires 12 connected thereto. The vertical portions of these partitions 34 are received in the spacings 35 between the lugs 17. In case the partitions 34 on the lead covers 28 are provided, the aforesaid partitions 25 on the coil cover 11 may be eliminated, and vice versa. However, it is possible to provide both partitions 25 and 34, and it is also possible, though not desirable, to dispense with both.

Figure 4:
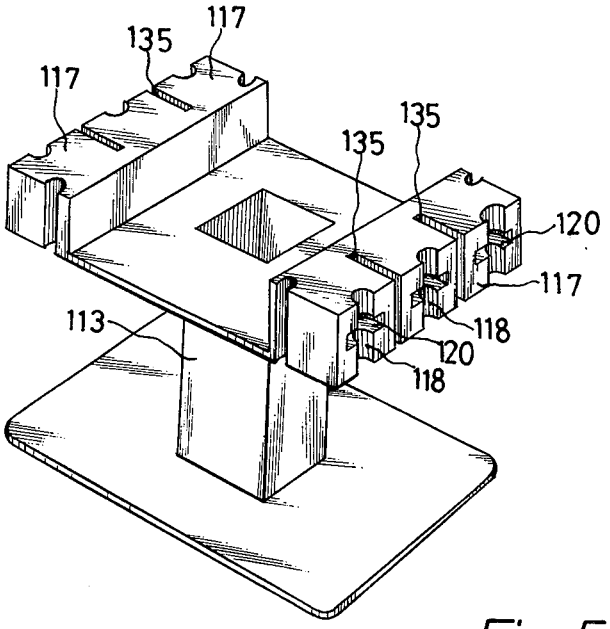
FIG. 4 is a perspective view of an alternative embodiment of the invention.

In an alternate embodiment of this invention shown in FIG. 4, a plurality of lugs 117 are formed in spaced side-by-side relationship on each of two opposite ends of the top flange of a bobbin 113 on which wires, not shown, are to be coiled to provide the primary and secondary windings of the transformer. Each lug 117 has formed therein first and second grooves 118 and 120 for engaging the respective flanged lead 19 shown in FIG. 3.

For connection to the leads 19, the terminal portions of the coiled wires may be threaded through spacings 135 between the lugs 117 onto their tops. It will be evident that a pair of lead covers similar to those shown in FIGS. 1 and 2 can be employed for enclosing parts of the leads and the exposed terminal portions of the coils of wire connected thereto. Other details of construction, functions and method of assemblage are believed to be clearly apparent from the foregoing description of FIGS. 1 through 3.

Figure 5:
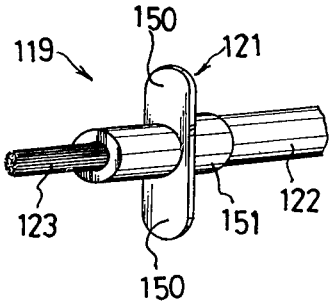
FIG. 5 is a fragmentary perspective view of a modification of the lead of FIG. 3.

FIG. 5 illustrates a modification of the lead 19 of FIG. 3. The modified lead, generally designated 119, has a flange 121 comprising a pair of winglike portions 150 formed integral with a sleeve 151 which is tightly fitted over an insulating covering 122 of a conductor 123. The modified lead 119 can be employed in lieu of the lead 19 in the first and second described embodiments of this invention, only with a slight modification in the shape of the second grooves 20 or 120.

Although this invention has been shown and described in terms of its specific embodiments, it is understood that the invention is not to be restricted by the exact details of this disclosure. For example, in the illustrated embodiments, the leads and the exposed terminal portions of the coiled wires connected thereto may be enveloped and retained in position by adhesive tape or the like, instead of by the snap-on covers. It is also recognized that the inventive principles are applicable to electrical devices other than transformers. The invention, therefore, should be construed broadly and in a manner consistent with the fair meaning or proper scope of the following claims.

What I claim is:

1. In a transformer having multiturn coils of wire, the combination comprising a coil cover of electrically insulating material enclosing said coils of wire, a plurality of leads each including a conductor having an insulating covering thereon, said conductors of said leads being connected to the respective terminal portions of said coils of wire led out of said coil cover, a flange on said insulating covering of each said lead, lug means formed on two opposite ends of said coil cover, said lug means on each end of said coil cover having formed therein a plurality of first grooves in spaced side-by-side relationship for receiving parts of said leads respectively and a plurality of second grooves for receiving said flanges of said leads respectively, each second groove being arranged crosswise with one of said first grooves, and a pair of lead covers securely mounted on said opposite ends of said coil cover, respectively, so as to enclose parts of said leads and the terminal portions of said coils of wire, said lead covers being adapted to hold said leads in position in said first grooves.

2. The combination as defined in claim 1, further comprising means for permitting said lead covers to snap into position on said coil cover.

3. The combination as defined in claim 1, further comprising partition means formed on the inside surface of each of said lead covers for isolating from each other said leads and the terminal portions of said coils of wire connected thereto.

4. The combination as defined in claim 1, further comprising partition means formed on said opposite ends of said coil cover for isolating the connections between said leads and the terminal portions of said coils of wire from each other.

5. A transformer comprising a bobbin, multiturn coils of wire wound on said bobbin, a coil cover of electrically insulating material enclosing said bobbin and said coils of wire, a core mounted on said coil cover to provide a magnetic circuit for said coils of wire, said coil cover having a plurality of openings formed therein on both sides of said core for permitting the terminal portions of said coils of wire to extend outwardly therethrough, a plurality of leads each including a conductor having an insulating covering thereon, said conductors of said leads being connected to the respective terminal portions of said coils of wire on the outside of said coil cover, a flange on said insulating covering of each said lead, lug means formed on two opposite ends of said coil cover located on both sides of said core, said lug means on each end of said coil cover having formed therein a plurality of first grooves in spaced side-by-side relationship for receiving parts of said leads respectively and a plurality of second grooves for receiving said flanges of said leads respectively, each second groove being arranged crosswise with one of said first grooves, and a pair of lead covers securely mounted on said opposite ends of said coil cover, rspectively, so as to enclose parts of said leads and the terminal portions of said coils of wire extending out of said openings, said lead covers being adapted to hold said leads in position in said first grooves.

6. The transformer as defined in claim 5, wherein said bobbin has a pair of flanges, and wherein the transformer further comprises a plurality of pins erected on one of said flanges of said bobbin and projecting outwardly through said openings in said coil cover, said terminal portions of said coils of wire being at least partly wound on said pins respectively.

* * * * *